US010986900B2

(12) United States Patent
Lee et al.

(10) Patent No.: US 10,986,900 B2
(45) Date of Patent: Apr. 27, 2021

(54) HAND FIXATION BAND

(71) Applicant: Cheng Uei Precision Industry Co., Ltd., New Taipei (TW)

(72) Inventors: Tsung Shih Lee, New Taipei (TW); Chi Ming Tseng, New Taipei (TW); Chia Fa Cheng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/593,130

(22) Filed: Oct. 4, 2019

(65) Prior Publication Data

US 2020/0367612 A1 Nov. 26, 2020

(30) Foreign Application Priority Data

May 24, 2019 (CN) ..... 201920756934.6

(51) Int. Cl.
*A44B 17/00* (2006.01)

(52) U.S. Cl.
CPC ..... *A44B 17/0005* (2013.01)

(58) Field of Classification Search
CPC ..... A44B 1/08; A45C 13/26; Y10T 16/455; Y10T 16/3831
See application file for complete search history.

(56) References Cited

U.S. PATENT DOCUMENTS

| | | | | |
|---|---|---|---|---|
| 2,735,700 | A * | 2/1956 | Bowan et al. | F16L 19/061 277/623 |
| 7,712,590 | B1 * | 5/2010 | Lee | A45C 13/26 190/115 |
| 7,850,243 | B2 * | 12/2010 | Sakamoto | B60N 2/2231 297/362 |
| 8,716,610 | B2 * | 5/2014 | Zyman Beer | G01G 19/58 177/148 |
| 9,583,078 | B1 * | 2/2017 | Nagahara | G10D 7/026 |
| 9,924,771 | B2 * | 3/2018 | Labey | A45C 3/06 |
| 10,716,366 | B2 * | 7/2020 | Puglia | A44B 1/08 |
| 2018/0163917 | A1 * | 6/2018 | Govindasamy | F16M 11/08 |
| 2020/0015551 | A1 * | 1/2020 | LeCompte | A44B 1/28 |
| 2020/0256639 | A1 * | 8/2020 | Larue | F41C 33/08 |

* cited by examiner

*Primary Examiner* — Victor D Batson
*Assistant Examiner* — Matthew J Sullivan
(74) *Attorney, Agent, or Firm* — Lin & Associates Intellectual Property, Inc.

(57) ABSTRACT

A hand fixation band includes a fastening band, a sliding arm and a damping element. The fastening band has a connecting portion. A bottom surface of the connecting portion is defined as a contact surface. The sliding arm is connected with the fastening band. A top surface of one end of the sliding arm is recessed downward to form an accommodating groove. Several portions of a top surface of a bottom wall of the accommodating groove protrude upward to form a plurality of buckling blocks. The damping element is disposed in the accommodating groove and contacts with the contact surface. Several portions of a bottom surface of the damping element are recessed upward to form a plurality of buckling holes. The plurality of the buckling blocks are buckled in the plurality of the buckling holes.

20 Claims, 4 Drawing Sheets

HAND FIXATION BAND

CROSS-REFERENCE TO RELATED APPLICATION

The present application is based on, and claims priority from, China Patent Application No. 201920756934.6, filed May 24, 2019, the disclosure of which is hereby incorporated by reference herein in its entirety.

BACKGROUND OF THE INVENTION

1. Field of the Invention

The present invention generally relates to a hand fixation band, and more particularly to a hand fixation band having a stable pivot structure.

2. The Related Art

A conventional hand fixation band is assembled to a rocker. The conventional hand fixation band includes a fastening band, a damping element and a sliding arm. The damping element is assembled between the fastening band and the sliding arm to form a pivot structure which is pivotal and fixed in place.

However, after the pivot structure of the conventional hand fixation band pivots for many times, the damping element will be deformed to be exposed outside on account of an friction affection. Thus an appearance and a function of the pivot structure of the conventional hand fixation band are affected.

In view of the above-mentioned problems, an innovative hand fixation band is essential to be provided, the innovative hand fixation band has a stable pivot structure, and the hand fixation band keeps a stable function and a normal appearance under a long time use of the hand fixation band.

SUMMARY OF THE INVENTION

An object of the present invention is to provide a hand fixation band assembled to a rocker. The hand fixation band includes a fastening band, a sliding arm and a damping element. The fastening band has a main portion, and a connecting portion protruded outward from a middle of one end of the main portion. A bottom surface of the connecting portion is defined as a contact surface. The sliding arm is connected with the fastening band. A top surface of one end of the sliding arm disposed under a free end of the connecting portion is recessed downward to form an accommodating groove. Several portions of a top surface of a bottom wall of the accommodating groove protrude upward to form a plurality of buckling blocks. The other end of the sliding arm opens at least one external fastening hole for being connected with the rocker. The fastening band is rotatable with respect to the sliding arm. Rotatable angles of the fastening band with respect to the sliding arm are any angles in an approximately horizontal direction. The damping element is disposed in the accommodating groove and contacts with the contact surface. Several portions of a bottom surface of the damping element are recessed upward to form a plurality of buckling holes corresponding to the plurality of the buckling blocks. The plurality of the buckling blocks are buckled in the plurality of the buckling holes. The damping element is blocked by a periphery of the one end of the sliding arm. When the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band and the sliding arm on account of a friction force pressing and pushing the damping element.

Another object of the present invention is to provide a hand fixation band assembled to a rocker. The hand fixation band includes a fastening band, a sliding arm, a damping element and a fixing assembly. The fastening band has a main portion, and a connecting portion protruded outward from one end of the main portion. A bottom surface of the connecting portion is defined as a contact surface. One end of the sliding arm is mounted under one end of the connecting portion. A top surface of the one end of the sliding arm is recessed downward to form an accommodating groove. Several portions of a top surface of a bottom wall of the accommodating groove protrude upward to form a plurality of buckling blocks. The other end of the sliding arm opens at least one external fastening hole for being connected with the rocker. The fastening band is rotatable with respect to the sliding arm. Rotatable angles of the fastening band with respect to the sliding arm are any angles in an approximately horizontal direction. The damping element is disposed in the accommodating groove. The contact surface of the sliding arm contacts with a top surface of the damping element. Several portions of a bottom surface of the damping element are recessed upward to form a plurality of buckling holes corresponding to the plurality of the buckling blocks. The plurality of the buckling blocks are buckled in the plurality of the buckling holes. The damping element is blocked by a periphery of the one end of the sliding arm. The fixing assembly is fastened between the sliding arm and the fastening band. When the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band, the sliding arm and the fixing assembly on account of a friction force pressing and pushing the damping element.

Another object of the present invention is to provide a hand fixation band assembled to a rocker. The hand fixation band includes a fastening band, a sliding arm, a damping element and a fixing assembly. The fastening band has a connecting portion. A bottom surface of the connecting portion is defined as a contact surface. One end of the sliding arm is mounted under one end of the connecting portion. A top surface of the one end of the sliding arm is recessed downward to form an accommodating groove. Several portions of a top surface of a bottom wall of the accommodating groove protrude upward to form a plurality of buckling blocks. The other end of the sliding arm opens at least one external fastening hole for being connected with the rocker. The fastening band is rotatable with respect to the sliding arm. Rotatable angles of the fastening band with respect to the sliding arm are any angles in an approximately horizontal direction. The damping element is integrally molded in the accommodating groove. The contact surface of the sliding arm contacts with a top surface of the damping element. Several portions of a bottom surface of the damping element are recessed upward to form a plurality of buckling holes corresponding to the plurality of the buckling blocks. The plurality of the buckling blocks are buckled in the plurality of the buckling holes. The damping element is blocked by a periphery of the one end of the sliding arm. The fixing assembly is fastened between the sliding arm and the fastening band. The fixing assembly includes an upper fixing element and a lower fixing element. The upper fixing element has an upper base portion, and an upper fastening pillar protruded downward from a bottom surface of the upper base portion. The lower fixing element has a lower base portion, and a lower fastening pillar protruded upward from a top surface of the lower base portion. The lower fixing element opens a fixing groove penetrating through a top surface of the lower fastening pillar and a bottom surface of the lower base portion. The lower fastening pillar passes upward through the first fastening hole, the third fastening hole and the second fastening hole. The upper fastening pillar is assembled in the fixing groove. The upper fixing element and the lower fixing element are fixed with each other. The sliding arm is connected with the fastening band by the fixing assembly to form a stable pivot structure so as to make the fastening band movable with respect to the sliding arm and to make the fastening band rotatable around the lower fastening pillar and the upper fastening pillar. When the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band, the sliding arm, and the upper fixing element and the lower fixing element of the fixing assembly on account of a friction force pressing and pushing the damping element.

As described above, the damping element of the hand fixation band is fastened in the accommodating groove of the sliding arm by virtue of the plurality of the buckling blocks of the sliding arm being buckled in the plurality of the buckling holes of the damping element, the damping element in the accommodating groove will be without being squeezed by a static friction force or a kinetic friction force to be deformed or shifted, and correspondingly the hand fixation band still keeps a stable function and a normal appearance under a long time use of the hand fixation band. Furthermore, the hand fixation band has the stable pivot structure.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
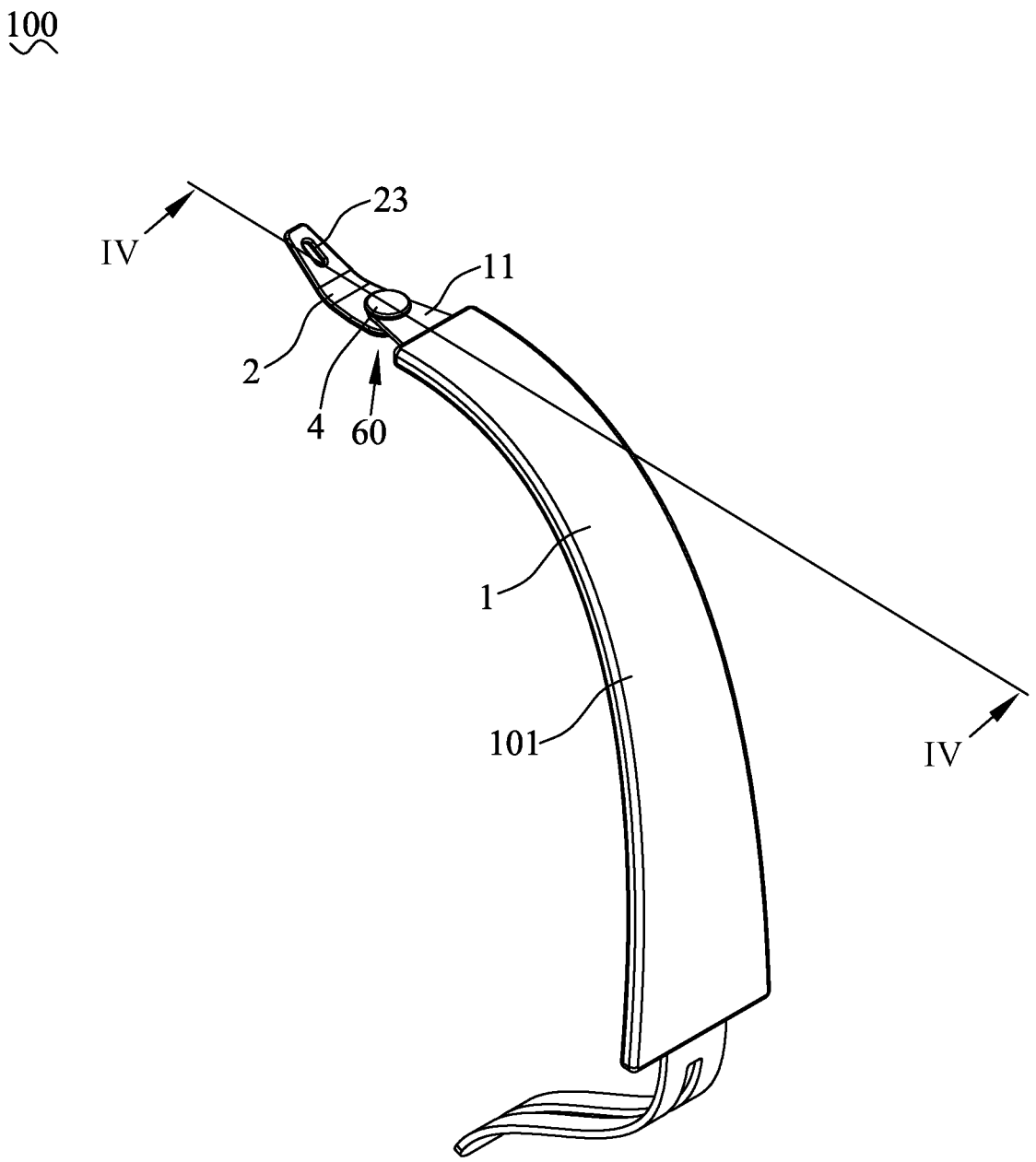
FIG. 1 is a perspective view of a hand fixation band in accordance with a preferred embodiment of the present invention.
Figure 2:
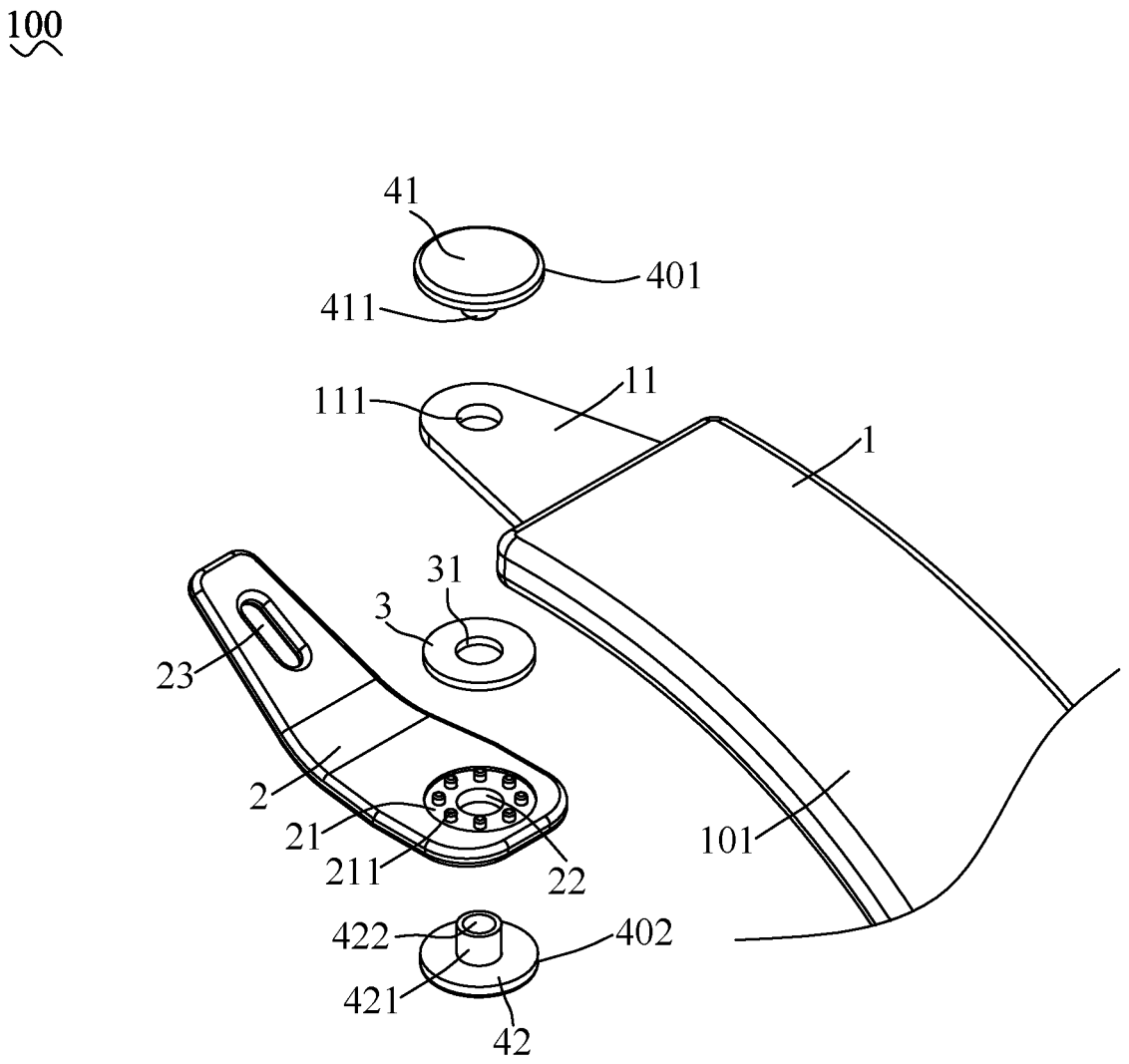
FIG. 2 is a partially exploded perspective view of the hand fixation band of FIG. 1.
Figure 3:
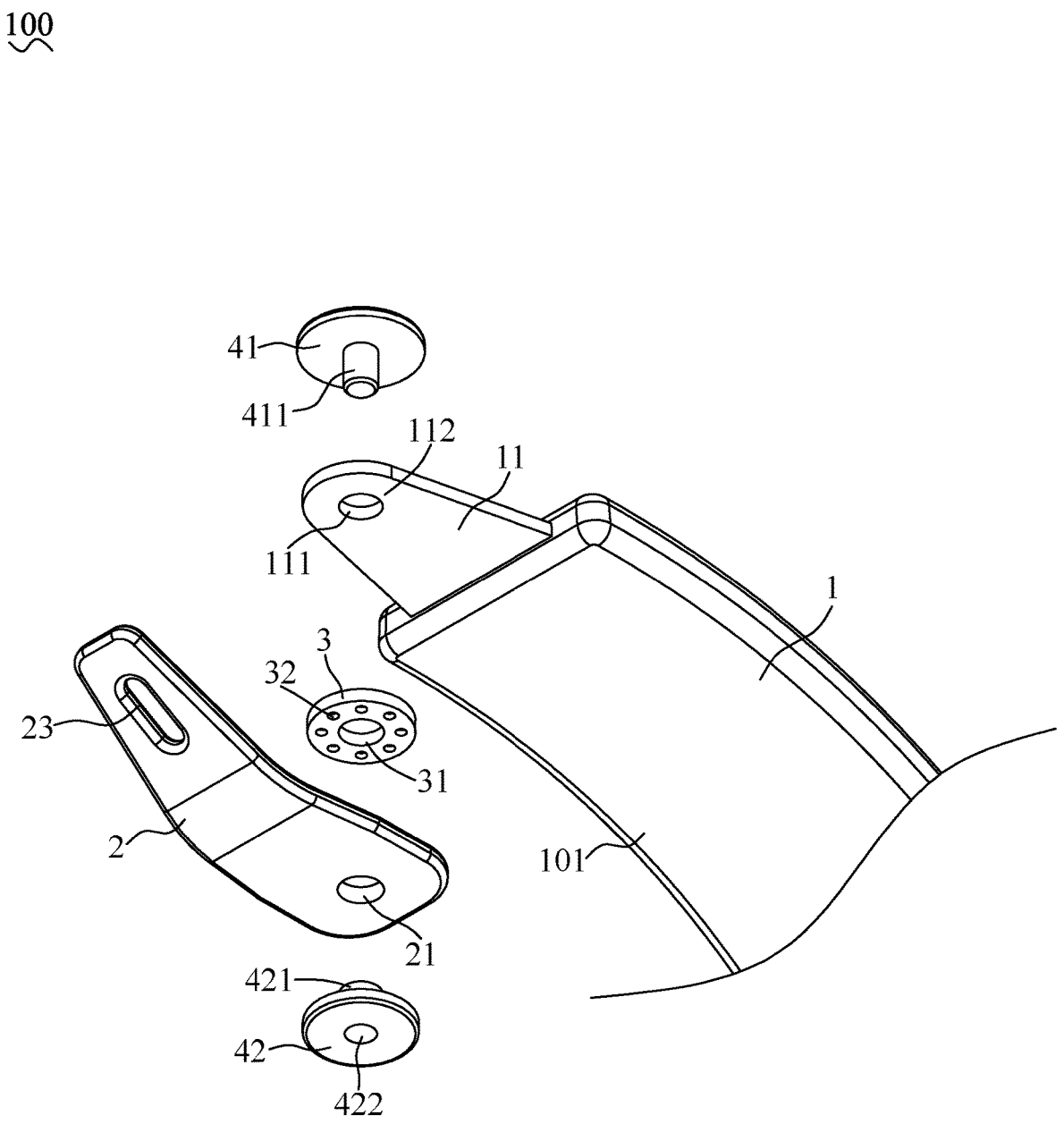
FIG. 3 is another partially exploded perspective view of the hand fixation band of FIG. 2.
Figure 4:
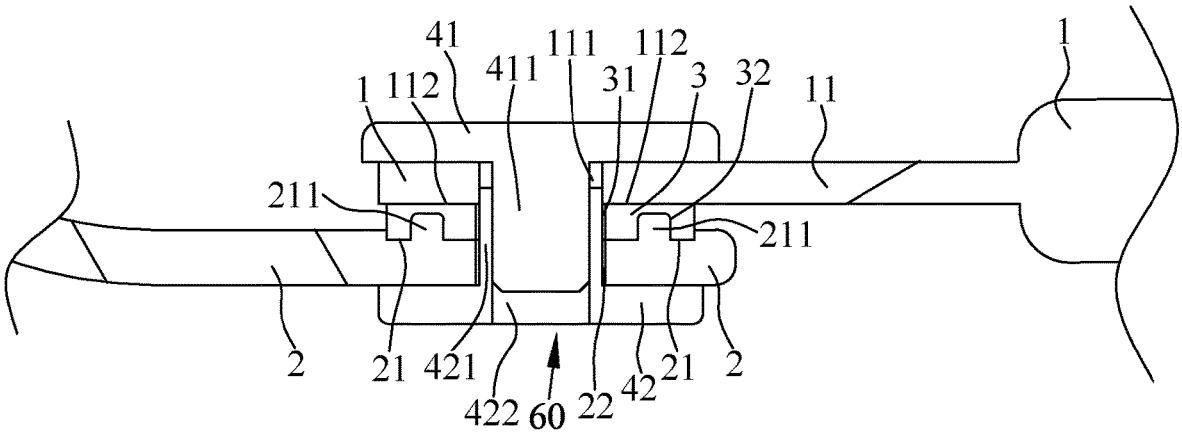
FIG. 4 is a partially sectional view of the hand fixation band along a line IV-IV of FIG. 1.

With reference to FIG. 1 to FIG. 3, a hand fixation band 100 in accordance with a preferred embodiment of the present invention is shown. The hand fixation band 100 is assembled to a rocker (not shown). The hand fixation band 100 includes a fastening band 1, a sliding arm 2, a damping element 3 and a fixing assembly 4. The hand fixation band 100 is flexible. The sliding arm 2, the damping element 3 together with the fixing assembly 4, and the fastening band 1 are sequentially arranged along an up-down direction.

The fastening band 1 has a main portion 101, and a connecting portion 11 protruded outward from a middle of one end of the main portion 101. The main portion 101 is shown as an arc shape. A bottom surface of the main portion 101 is arched upward and frontward. A middle of a free end of the connecting portion 11 opens a first fastening hole 111. A bottom surface of the connecting portion 11 of the fastening band 1 is defined as a contact surface 112.

The sliding arm 2 is connected with the fastening band 1. One end of the sliding arm 2 is mounted under one end of the connecting portion 11. The sliding arm 2 is made of a plastic material. A top surface of the one end of the sliding arm 2 disposed under a free end of the connecting portion 11 of the fastening band 1 is recessed downward to form an accommodating groove 21. Specifically, the accommodating groove 21 is shown as a circular ring shape. Several portions of a top surface of a bottom wall of the accommodating groove 21 protrude upward to form a plurality of buckling blocks 211. The plurality of the buckling blocks 211 are arranged as an annulus shape. A middle of the bottom wall of the accommodating groove 21 is hollow, so the middle of the bottom wall of the accommodating groove 21 has a second fastening hole 22 therein. The second fastening hole 22 is communicated with the accommodating groove 21. The second fastening hole 22 is disposed corresponding to the first fastening hole 111. The other end of the sliding arm 2 opens at least one external fastening hole 23. The at least one external fastening hole 23 is used for being connected with the rocker.

The damping element 3 is disposed in the accommodating groove 21 and contacts with the contact surface 112. The damping element 3 is blocked by a periphery of the one end of the sliding arm 2. The damping element 3 is shown as the circular ring shape and is matched with the accommodating groove 21. Specifically, a material of the damping element 3 is rubber. The damping element 3 is accommodated in and integrally molded in the accommodating groove 21 by an integral injection molding technology. The sliding arm 2 and the damping element 3 are integrally molded by a double-material injection molding way of rubber and plastic materials, and adhesive forces generated among molecules of the rubber and plastic materials are stronger. A middle of the damping element 3 opens a third fastening hole 31. The third fastening hole 31 is disposed corresponding to the first fastening hole 111. Several portions of a bottom surface of the damping element 3 are recessed upward to form a plurality of buckling holes 32. The plurality of the buckling holes 32 are arranged as the annulus shape and are corresponding to the plurality of the buckling blocks 211. The plurality of the buckling blocks 211 are buckled in the plurality of the buckling holes 32.

Referring to FIG. 1 to FIG. 4, the fixing assembly 4 is fastened between the sliding arm 2 and the fastening band 1. The fixing assembly 4 includes an upper fixing element 41, and a lower fixing element 42 fixed with and matched with the upper fixing element 41. The upper fixing element 41 has a circular upper base portion 401, and an upper fastening pillar 411 protruded downward from a middle of a bottom surface of the upper base portion 401. The lower fixing element 42 has a circular lower base portion 402, and a lower fastening pillar 421 protruded upward from a middle of a top surface of the lower base portion 402. A middle of the lower fixing element 42 opens a fixing groove 422 extending vertically, and penetrating through a top surface of the lower fastening pillar 421 and a bottom surface of the lower base portion 402. The fixing groove 422 is disposed corresponding to the upper fastening pillar 411.

Specifically, the fixing assembly 4 is a rivet assembly. When the hand fixation band 100 is assembled, the damping element 3 is accommodated in the accommodating groove 21 of the sliding arm 2. The sliding arm 2 and the damping element 3 are integrally molded by the double injection molding way. At the moment, the plurality of the buckling blocks 211 of the sliding arm 2 are buckled in the plurality of the buckling holes 32 of the damping element 3. The connecting portion 11 of the fastening band 1 is positioned on the damping element 3. The contact surface 112 of the sliding arm 2 contacts with a top surface of the damping element 3. At the moment, the first fastening hole 111, the third fastening hole 31 and the second fastening hole 22 are communicated with one another. The lower fastening pillar 421 of the lower fixing element 42 passes upward through the first fastening hole 111, the third fastening hole 31 and the second fastening hole 22. The upper fastening pillar 411 of the fixing assembly 4 is assembled in the fixing groove 422, so that the upper fixing element 41 and the lower fixing element 42 are fixed with each other, and correspondingly the fastening band 1, the damping element 3 and the sliding arm 2 are combined by the fixing assembly 4.

Because the sliding arm 2 and the damping element 3 are integrally molded by virtue of the double injection molding way, the plurality of the buckling blocks 211 of the sliding arm 2 are integrated with the plurality of the buckling holes 32 of the damping element 3 tightly. Comparing an assembling way of the damping element and the sliding arm in prior art with the double injection molding way of the sliding arm 2 and the damping element 3, a stronger adhesive force between the sliding arm 2 and the damping element 3 is generated. In addition, assembling procedures of the hand fixation band 100 are saved, so that programs and time in a manufacturing process of the hand fixation band 100 are saved.

When the hand fixation band 100 of the rocker is held by a user, the fastening band 1 surrounds a hand of the user to make the hand of the user hold the rocker stably. The sliding arm 2 is connected with the fastening band 1 and the rocker. The sliding arm 2 is connected with the fastening band 1 by the fixing assembly 4 to form a stable pivot structure 60 so as to make the fastening band 1 movable with respect to the sliding arm 2, and to make the fastening band 1 rotatable around the lower fastening pillar 421 and the upper fastening pillar 411. The fastening band 1 is rotatable with respect to the sliding arm 2, rotatable angles of the fastening band 1 with respect to the sliding arm 2 are any angles in an approximately horizontal direction. When the connecting portion 11 of the fastening band 1 is rotated with respect to the sliding arm 2, and one of the rotatable angles of the fastening band 1 with respect to the sliding arm 2 is 360 degrees in the approximately horizontal direction, the damping element 3 is without being deformed and exposed beyond outer surfaces of the connecting portion 11 of the fastening band 1, the sliding arm 2, and the upper fixing element 41 and the lower fixing element 42 of the fixing assembly 4 on account of a friction force pressing and pushing the damping element 3. The fixing assembly 4 is fastened between the sliding arm 2 and the fastening band 1. The hand fixation band 100 is appropriate for each of hand shapes of different users by virtue of adjusting a position of the fastening band 1 of the hand fixation band 100. So when the user adjusts the position of the fastening band 1 of the hand fixation band 100, the fastening band 1 and the sliding arm 2 will generate a pivot rotation by means of a pivoting portion 403 of the fixing assembly 4 pivotally connected between the fastening band 1 and the sliding arm 2. The pivoting portion 403 of the fixing assembly 4 includes the lower fastening pillar 421 and the upper fastening pillar 411. In the preferred embodiment, the fastening band 1 and the sliding arm 2 will generate the pivot rotation by means of the upper fastening pillar 411 and the lower fastening pillar 421 of the fixing assembly 4. At the moment, the damping element 3 disposed between the fastening band 1 and the sliding arm 2 is capable of providing a static friction force and a kinetic friction force. The static friction force is capable of making the fastening band 1 and the sliding arm 2 complete a location between the fastening band 1 and the sliding arm 2 after the fastening band 1 and the sliding arm 2 generate the pivot rotation. When the user adjusts the position of the fastening band 1, the kinetic friction force will be without affecting that the fastening band 1 and the sliding arm 2 proceed with the pivot rotation between the fastening band 1 and the sliding arm 2. When the connecting portion 11 of the fastening band 1 is rotated with respect to the sliding arm 2, the damping element 3 is without being deformed and exposed beyond the outer surfaces of the connecting portion 11 of the fastening band 1, the sliding arm 2, and the upper fixing element 41 and the lower fixing element 42 of the fixing assembly 4 on account of the friction force pressing and pushing the damping element 3.

The damping element 3 and the sliding arm 2 are integrally molded by virtue of the double injection molding way, so that the stronger adhesive force between the plurality of the buckling blocks 211 of the sliding arm 2 and the plurality of the buckling holes 32 of the damping element 3 is generated. When the fastening band 1 and the sliding arm 2 proceed with the pivot rotation, the plurality of the buckling blocks 211 are buckled in the plurality of the buckling holes 32, so that the damping element 3 is fastened in the accommodating groove 21 of the sliding arm 2, the damping element 3 in the accommodating groove 21 will be without being squeezed by the static friction force or the kinetic friction force to be deformed or shifted, and correspondingly the hand fixation band 100 still keeps a stable function and a normal appearance under a long time use of the hand fixation band 100.

As described above, the damping element 3 of the hand fixation band 100 is fastened in the accommodating groove 21 of the sliding arm 2 by virtue of the plurality of the buckling blocks 211 of the sliding arm 2 being buckled in the plurality of the buckling holes 32 of the damping element 3, the damping element 3 in the accommodating groove 21 will be without being squeezed by the static friction force or the kinetic friction force to be deformed or shifted, and correspondingly the hand fixation band 100 still keeps the stable function and the normal appearance under the long time use of the hand fixation band 100. Furthermore, the hand fixation band 100 has the stable pivot structure 60.

What is claimed is:

1. A hand fixation band assembled to a rocker, comprising:

a fastening band having a main portion, and a connecting portion protruded outward from a middle of one end of the main portion, a bottom surface of the connecting portion being defined as a contact surface;

a sliding arm connected with the fastening band, a top surface of one end of the sliding arm disposed under a free end of the connecting portion being recessed downward to form an accommodating groove, several portions of a top surface of a bottom wall of the accommodating groove protruding upward to form a plurality of buckling blocks, the other end of the sliding arm opening at least one external fastening hole for being connected with the rocker, the fastening band being rotatable with respect to the sliding arm, rotatable angles of the fastening band with respect to the sliding arm being any angles in an approximately horizontal direction; and a damping element disposed in the accommodating groove and contacting with the contact surface, several portions of a bottom surface of the damping element being recessed upward to form a plurality of buckling holes corresponding to the plurality of the buckling blocks, the plurality of the buckling blocks being buckled in the plurality of the buckling holes, the damping element being blocked by a periphery of the one end of the sliding arm, wherein when the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band and the sliding arm on account of a friction force pressing and pushing the damping element.

2. The hand fixation band as claimed in claim 1, wherein the damping element is accommodated in and integrally molded in the accommodating groove by an integral injection molding technology.

3. The hand fixation band as claimed in claim 1, wherein a material of the damping element is rubber.

4. The hand fixation band as claimed in claim 1, wherein the sliding arm is made of a plastic material.

5. The hand fixation band as claimed in claim 1, wherein the accommodating groove is shown as a circular ring shape, the damping element is shown as the circular ring shape and is matched with the accommodating groove.

6. The hand fixation band as claimed in claim 1, wherein the plurality of the buckling blocks are arranged as an annulus shape, the plurality of the buckling holes are arranged as the annulus shape.

7. The hand fixation band as claimed in claim 1, wherein a middle of a free end of the connecting portion opens a first fastening hole, a middle of the bottom wall of the accommodating groove is hollow, so the middle of the bottom wall of the accommodating groove has a second fastening hole, a middle of the damping element opens a third fastening hole, the first fastening hole, the third fastening hole and the second fastening hole are communicated with one another.

8. The hand fixation band as claimed in claim 7, further comprising a fixing assembly fastened between the sliding arm and the fastening band, the fixing assembly including an upper fixing element and a lower fixing element, the upper fixing element having an upper base portion, and an upper fastening pillar protruded downward from a bottom surface of the upper base portion, the lower fixing element having a lower base portion, and a lower fastening pillar protruded upward from a top surface of the lower base portion, the lower fixing element opening a fixing groove extending vertically, and penetrating through a top surface of the lower fastening pillar and a bottom surface of the lower base portion, the fixing groove being disposed corresponding to the upper fastening pillar, the lower fastening pillar of the lower fixing element passing upward through the first fastening hole, the third fastening hole and the second fastening hole, the upper fastening pillar being assembled in the fixing groove, the upper fixing element and the lower fixing element being fixed with each other, and correspondingly the fastening band, the damping element and the sliding arm being combined by the fixing assembly.

9. The hand fixation band as claimed in claim 1, wherein the damping element and the sliding arm are integrally molded by virtue of a double-material injection molding way of rubber and plastic materials, and adhesive forces generated among molecules of the rubber and plastic materials are stronger, when the connecting portion of the fastening band is rotated with respect to the sliding arm, the damping element is without being deformed and exposed beyond the outer surfaces of the connecting portion of the fastening band and the sliding arm on account of the friction force pressing and pushing the damping element.

10. A hand fixation band assembled to a rocker, comprising:

a fastening band having a main portion, and a connecting portion protruded outward from one end of the main portion, a bottom surface of the connecting portion being defined as a contact surface;

a sliding arm, one end of the sliding arm being mounted under one end of the connecting portion, a top surface of the one end of the sliding arm being recessed downward to form an accommodating groove, several portions of a top surface of a bottom wall of the accommodating groove protruding upward to form a plurality of buckling blocks, the other end of the sliding arm opening at least one external fastening hole for being connected with the rocker, the fastening band being rotatable with respect to the sliding arm, rotatable angles of the fastening band with respect to the sliding arm being any angles in an approximately horizontal direction;

a damping element disposed in the accommodating groove, the contact surface of the sliding arm contacting with a top surface of the damping element, several portions of a bottom surface of the damping element being recessed upward to form a plurality of buckling holes corresponding to the plurality of the buckling blocks, the plurality of the buckling blocks being buckled in the plurality of the buckling holes, the damping element being blocked by a periphery of the one end of the sliding arm; and a fixing assembly fastened between the sliding arm and the fastening band, wherein when the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band, the sliding arm and the fixing assembly on account of a friction force pressing and pushing the damping element.

11. The hand fixation band as claimed in claim 10, wherein the damping element is accommodated in and integrally molded in the accommodating groove by an integral injection molding technology.

12. The hand fixation band as claimed in claim 10, wherein a material of the damping element is rubber.

13. The hand fixation band as claimed in claim 10, wherein the sliding arm is made of a plastic material.

14. The hand fixation band as claimed in claim 10, wherein the accommodating groove is shown as a circular ring shape, the damping element is shown as the circular ring shape and is matched with the accommodating groove.

15. The hand fixation band as claimed in claim 10, wherein the plurality of the buckling blocks are arranged as an annulus shape, the plurality of the buckling holes are arranged as the annulus shape.

16. The hand fixation band as claimed in claim 10, wherein a middle of a free end of the connecting portion opens a first fastening hole, a middle of the bottom wall of the accommodating groove is hollow, so the middle of the bottom wall of the accommodating groove has a second fastening hole, a middle of the damping element opens a third fastening hole, the first fastening hole, the third fastening hole and the second fastening hole are communicated with one another.

17. The hand fixation band as claimed in claim 16, wherein the fixing assembly includes an upper fixing element and a lower fixing element, the upper fixing element has an upper base portion, and an upper fastening pillar protruded downward from a bottom surface of the upper base portion, the lower fixing element has a lower base portion, and a lower fastening pillar protruded upward from a top surface of the lower base portion, the lower fixing element opens a fixing groove extending vertically, and penetrating through a top surface of the lower fastening pillar and a bottom surface of the lower base portion, the fixing groove is disposed corresponding to the upper fastening pillar, the lower fastening pillar of the lower fixing element passes upward through the first fastening hole, the third fastening hole and the second fastening hole, the upper fastening pillar is assembled in the fixing groove, the upper fixing element and the lower fixing element are fixed with each other, and correspondingly the fastening band, the damping element and the sliding arm are combined by the fixing assembly.

18. The hand fixation band as claimed in claim 10, wherein the damping element and the sliding arm are integrally molded by virtue of a double-material injection molding way of rubber and plastic materials, and adhesive forces generated among molecules of the rubber and plastic materials are stronger, when the connecting portion of the fastening band is rotated with respect to the sliding arm, the damping element is without being deformed and exposed beyond the outer surfaces of the connecting portion of the fastening band, the sliding arm and the fixing assembly on account of the friction force pressing and pushing the damping element.

19. A hand fixation band assembled to a rocker, comprising:

a fastening band having a connecting portion, a bottom surface of the connecting portion being defined as a contact surface;

a sliding arm, one end of the sliding arm being mounted under one end of the connecting portion, a top surface of the one end of the sliding arm being recessed downward to form an accommodating groove, several portions of a top surface of a bottom wall of the accommodating groove protruding upward to form a plurality of buckling blocks, the other end of the sliding arm opening at least one external fastening hole for being connected with the rocker, the fastening band being rotatable with respect to the sliding arm, rotatable angles of the fastening band with respect to the sliding arm being any angles in an approximately horizontal direction;

a damping element integrally molded in the accommodating groove, the contact surface of the sliding arm contacting with a top surface of the damping element, several portions of a bottom surface of the damping element being recessed upward to form a plurality of buckling holes corresponding to the plurality of the buckling blocks, the plurality of the buckling blocks being buckled in the plurality of the buckling holes, the damping element being blocked by a periphery of the one end of the sliding arm; and a fixing assembly fastened between the sliding arm and the fastening band, the fixing assembly including an upper fixing element and a lower fixing element, the upper fixing element having an upper base portion, and an upper fastening pillar protruded downward from a bottom surface of the upper base portion, the lower fixing element having a lower base portion, and a lower fastening pillar protruded upward from a top surface of the lower base portion, the lower fixing element opening a fixing groove penetrating through a top surface of the lower fastening pillar and a bottom surface of the lower base portion, the lower fastening pillar passing upward through the first fastening hole, the third fastening hole and the second fastening hole, the upper fastening pillar being assembled in the fixing groove, the upper fixing element and the lower fixing element being fixed with each other, wherein the sliding arm is connected with the fastening band by the fixing assembly to form a stable pivot structure so as to make the fastening band movable with respect to the sliding arm, and to make the fastening band rotatable around the lower fastening pillar and the upper fastening pillar, when the connecting portion of the fastening band is rotated with respect to the sliding arm, and one of the rotatable angles of the fastening band with respect to the sliding arm is 360 degrees in the approximately horizontal direction, the damping element is without being deformed and exposed beyond outer surfaces of the connecting portion of the fastening band, the sliding arm, and the upper fixing element and the lower fixing element of the fixing assembly on account of a friction force pressing and pushing the damping element.

20. The hand fixation band as claimed in claim 19, wherein the damping element and the sliding arm are integrally molded by virtue of a double-material injection molding way of rubber and plastic materials, and adhesive forces generated among molecules of the rubber and plastic materials are stronger, when the connecting portion of the fastening band is rotated with respect to the sliding arm, the damping element is without being deformed and exposed beyond the outer surfaces of the connecting portion of the fastening band, the sliding arm, and the upper fixing element and the lower fixing element of the fixing assembly on account of the friction force pressing and pushing the damping element.

* * * * *